US005312566A

United States Patent [19]

Carroll et al.

[11] Patent Number: 5,312,566

[45] Date of Patent: May 17, 1994

[54] AIR INTAKE SYSTEM DEVICE

[75] Inventors: Robert Carroll, Bradbury; David Gann, Newport Beach, both of Calif.; Loren Zanier; Rod L. Quinn, both of Bend, Oreg.

[73] Assignee: American Technologies Group, Inc.

[21] Appl. No.: 941,778

[22] Filed: Sep. 9, 1992

[51] Int. Cl.[5] ..... B01F 3/04

[52] U.S. Cl. ..... 261/18.4; 239/54; 239/55; 239/60

[58] Field of Search ..... 261/18.4, 18.2; 239/55, 239/54, 60

[56] References Cited

U.S. PATENT DOCUMENTS

| | | | |
|---|---|---|---|
| Re. 32,513 | 10/1987 | Seaber et al. | 239/54 |
| 1,183,483 | 5/1916 | O'Hara . | |
| 1,605,966 | 11/1926 | McKenzie-Martyn . | |
| 1,623,053 | 4/1927 | Howard et al. | 261/18.4 |
| 1,626,159 | 4/1927 | Schmitt | 261/18.2 |
| 1,626,798 | 5/1927 | Fay | 261/18.2 |
| 1,684,757 | 9/1928 | Coleman | 261/18.2 |
| 1,755,733 | 4/1930 | Hager et al. | 261/18.2 |
| 1,975,619 | 10/1934 | Rector . | |
| 2,064,561 | 12/1936 | O'Sullivan . | |
| 2,086,775 | 7/1937 | Lyons et al. . | |
| 2,182,874 | 12/1939 | Kowalski . | |
| 2,216,477 | 10/1940 | O'Sullivan . | |
| 2,353,926 | 7/1944 | Peters | 261/18.2 |
| 2,537,495 | 1/1951 | Wallin | 261/18.2 |
| 2,602,435 | 7/1952 | Boyan . | |
| 2,613,991 | 10/1952 | Schindler | 239/60 |
| 2,630,794 | 3/1953 | Baxter . | |
| 2,669,319 | 2/1954 | Inglesby | 261/18.2 |
| 2,695,680 | 11/1954 | Lundy . | |
| 2,720,419 | 10/1955 | Eby | 239/54 |
| 2,766,067 | 10/1956 | Shinberg | 239/54 |
| 2,839,037 | 6/1958 | McKeever . | |
| 3,450,116 | 6/1969 | Knight et al. . | |
| 3,862,819 | 1/1975 | Wentworth, Jr. . | |
| 3,888,954 | 6/1975 | Eberle | 261/18.2 |
| 3,991,724 | 11/1976 | Geiser | 261/18.2 |
| 4,014,637 | 3/1977 | Schena . | |
| 4,016,827 | 4/1977 | Lawrence, Jr. . | |
| 4,223,642 | 9/1980 | Okubo . | |
| 4,285,468 | 8/1981 | Hyman | 239/55 |
| 4,306,519 | 12/1981 | Schoenhard | 261/18.2 |
| 4,306,520 | 12/1981 | Slaton . | |
| 4,418,654 | 12/1983 | Keiun . | |
| 4,475,483 | 10/1984 | Robinson | 261/18.2 |
| 4,494,487 | 1/1985 | Nixon . | |
| 4,557,222 | 12/1985 | Nelson . | |
| 5,065,704 | 11/1991 | Powell | 261/18.2 |

FOREIGN PATENT DOCUMENTS

| | | |
|---|---|---|
| 75501 | 7/1954 | Netherlands . |
| 368513 | 3/1932 | United Kingdom . |

OTHER PUBLICATIONS

Carbex Publication, no evident date, one page.

*Primary Examiner*—Tim Miles
*Attorney, Agent, or Firm*—Ladas & Parry

[57] ABSTRACT

This invention is an air cleaning and/or performance enhancement device. It is made of a porous outer covering and an inside agent. The inside agent outgasses through the outside covering. The device may be placed in air filters or other convenient locations to reduce toxic emissions and modify fuel consumption.

13 Claims, 4 Drawing Sheets

AIR INTAKE SYSTEM DEVICE

BACKGROUND OF THE INVENTION

In view of the worldwide pollution, there is a need to reduce harmful emissions caused by fossil fuel engines. The present invention is a simplified emission control device which may be placed in the air filter or other convenient location of the incoming air or oxidizer stream (a car grill is one example) of such an engine and which reduces toxic emissions.

There have been numerous attempts to devise emission controls. There are those which attempt to deliver a catalyst into a combustion chamber. U.S. Pat. No. 4,475,483 issued in the name of B. Robinson uses a container of catalytic solution wherein air is bubbled through the solution to absorb the catalyst. The air is then passed into the incoming air stream of a combustion engine.

Other references of note are U.S. Pat. No. 4,306,519 issued to Schoenhard; U.S. Pat. No. 4,557,222 issued to Nelson; U.S. Pat. No. 4,306,520 issued to Slaton; U.S. Pat. No. 4,016,827 issued to Wentworth, Jr.; U.S. Pat. No. 4,014,637 issued to Scena; U.S. Pat. No. 3,862,819 issued to Wentworth, Jr.; and U.S. Pat. No. 3,450,116 issued to Knight. All of these devices set forth means to improve the combustion process by effecting an incoming air stream. Each of these devices employ mechanical and/or electrical means to introduce the catalyst into the incoming air. The present invention greatly simplifies this procedure in that it employs no mechanical or electrical components, has no moving parts, and uses a simple out-gassing capillary action to release the catalyst. Because of its design simplicity, it requires no mechanical expertise to use or install.

SUMMARY OF THE INVENTION

Disclosed herein is a device comprised of an outer covering; an inside agent; means to enable the inside agent to out-gas through the outer covering. The device attempts to be an air cleaning and performance improving device.

DESCRIPTION OF THE DRAWINGS

The present invention is well exemplified by the following drawings.

DETAILED DESCRIPTION OF THE INVENTION

Figure 1B:
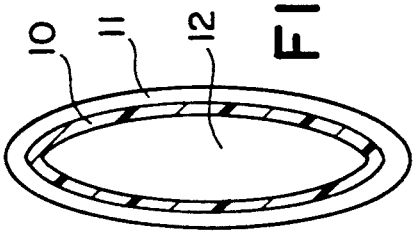
FIG. 1*b* is a cross-sectional view taken along line b—b of FIG. 1.
Figure 1A:
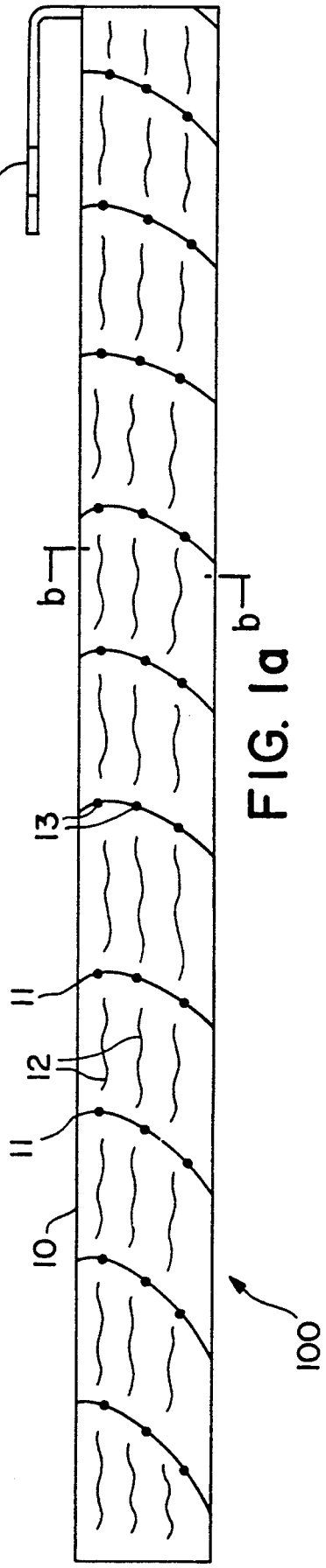
FIG. 1*a* is a side view of the invention.

The present invention as best seen in FIG. 1*a* is an air modifier device (100) which may be placed anywhere in the air intake system of a combustion engine. The air modifier device (100) includes an out-gassing catalyst (12) or an agent that can act as or like a catalyst within its generally tubular body (10). Such catalysts (12) are known in the art and may include diluted platinum chloride or like substances. The body (10) is made of a flexible or non flexible material such as plastic which enables the out-gassing of the catalyst (12) at a given rate into the incoming air stream of a combustion engine.

A plurality of perforations (13) are defined in the flexible casing package, container, or body (10) to control the rate of the out-gassing. The body (10) may contain an absorbent material such as beads which are fully moistened by the catalyst (12) and assist and affect the evaporation rate of the catalyst (12). The perforations (13) may extend along the entire surface of the outside covering (10) or may, as shown in FIG. 1*a* be spaced intermittently along a line which defines the circumference of the covering. Also seen in FIG. 1*a* are wicks (11) which intermittently surround the diameter of body (10). FIG. 1*b* is a cross-sectional view of filter device (100) as shown in FIG. 1*a* and taken along line b—b. Other positioning may be used however such as paralleling the length of the body (10) or otherwise located. The wicks (11) can be made of an absorbent material such as felt which will absorb the catalyst (12) from inside body (10) and allow it to evaporate outside of body (10). On the other hand, the wicks may be made from body (10) or other materials may be used even non absorbent materials as long as the material accomplishes a wicking effect. In FIG. 1*a*, the wicks (11) are shown intermittently and evenly spaced along the length of body (10).

A clip (14) extends from the end of the container or body (10) for clipping the device (100) inside an air filter or other convenient locations to affect the incoming air or oxidizer stream.

Figure 2:
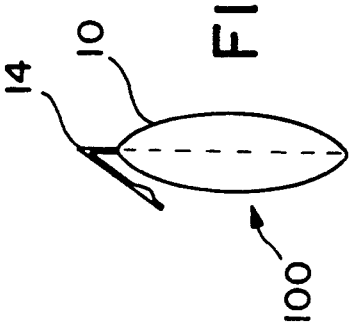
FIG. 2 is an end view of the invention.

FIG. 2 merely portrays the end view of the container or body (10). In this instance, it has somewhat of an egg shape or the shape of a somewhat collapsed circle. Body (10) is preferably sealed and the catalyst may be injected therein if the body (10) is formed first sealed. Otherwise, the catalyst (12) may be added during the formation process as is well known in the art. If the absorbent material is used, it will absorb the catalyst (12). Clip (14) can be seen extending from the end shown in FIG. 2.

Figure 3A:
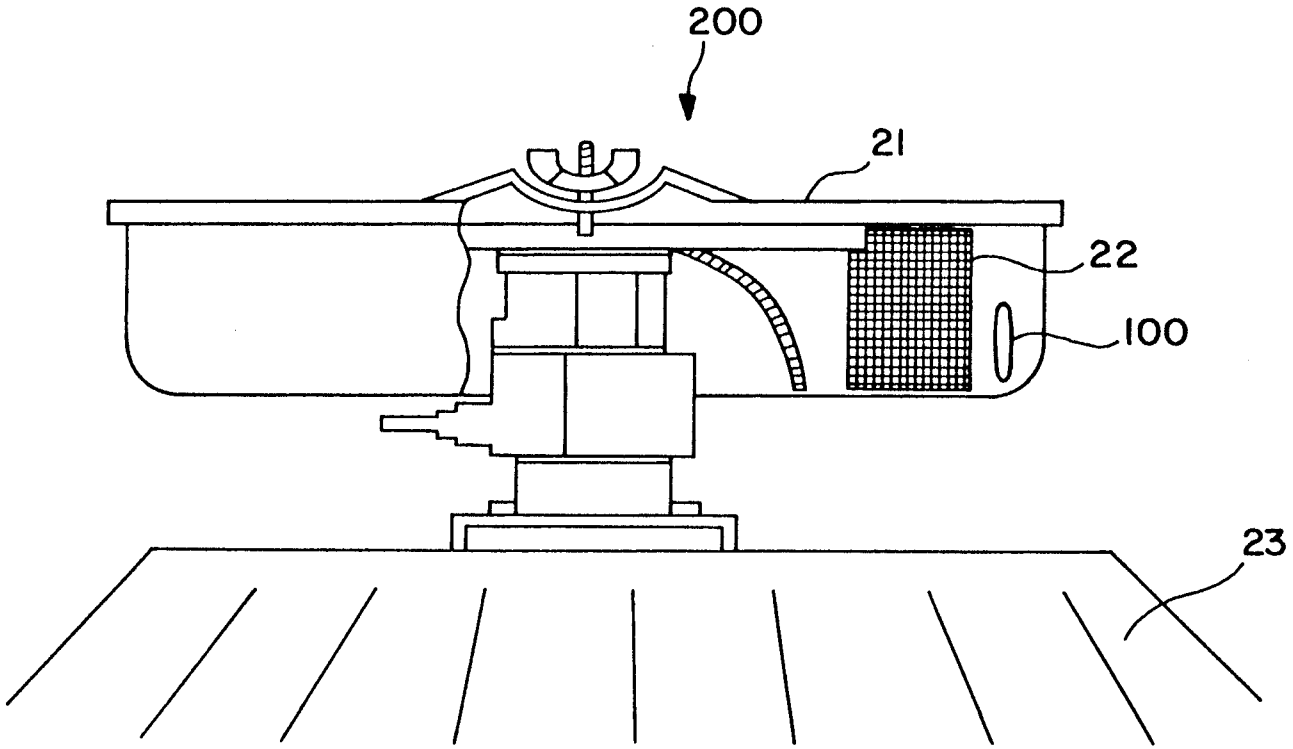
FIG. 3A is a diagrammatic view of the invention in an air filter.

In FIG. 3A an air cleaner (200) is shown containing the device (100) of FIG. 1*a*. The top cover (21) of the cleaner assembly is denoted as is the car or truck engine (23) to which the air cleaner is secured. Air filter (22) is seen resting within air cleaner (200) and the end of device (100) is seen located between the air filter (22) resting toward the outside circumference of air cleaner (200).

Figure 3B:
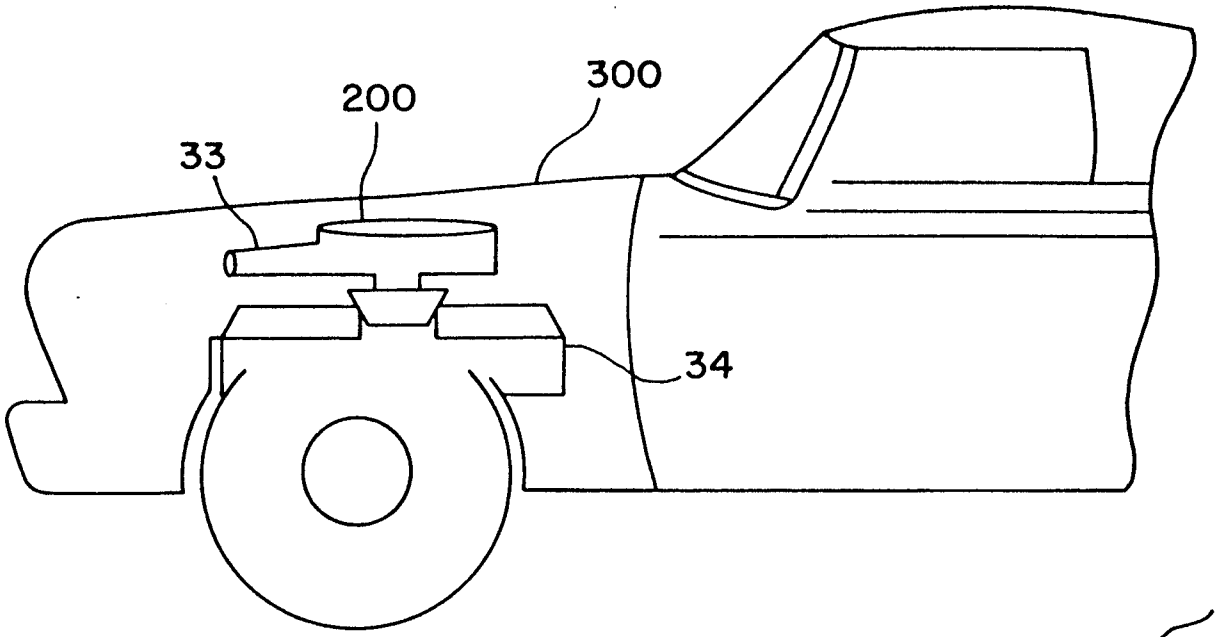
FIG. 3B is a diagrammatic view of an automobile with an air filter.

In FIG. 3B an air cleaner (200) is shown located in an automobile (300). The automobile engine (34) is attached to the air cleaner assembly (200). The air intake of the air cleaner is denoted by reference numeral (33).

Figure 3C:
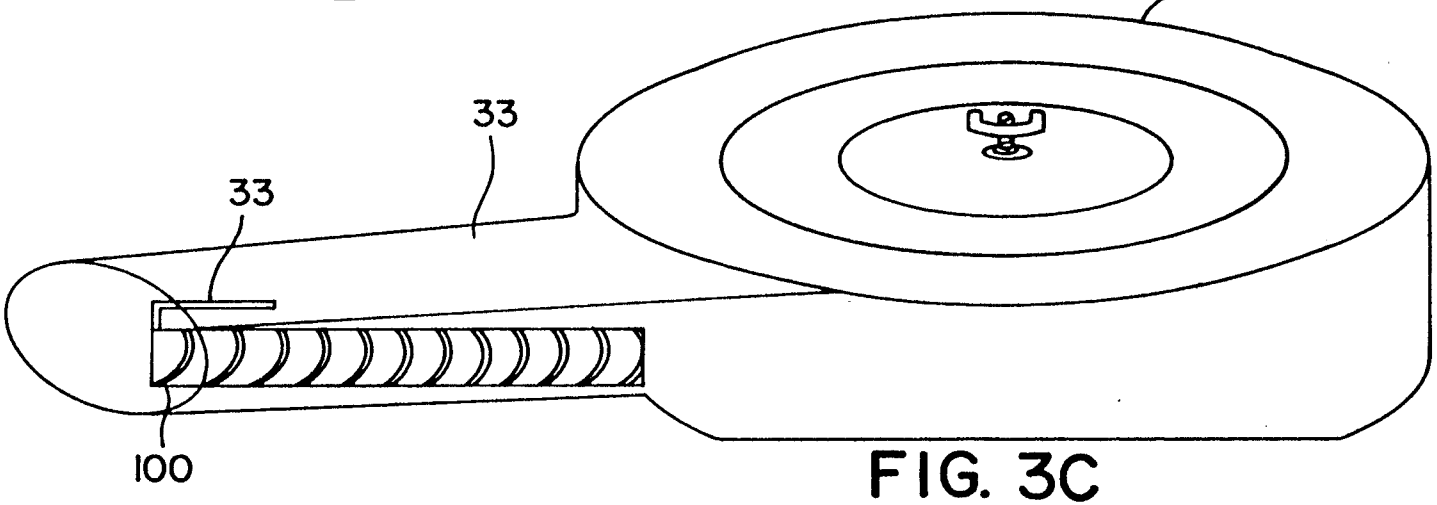
FIG. 3C is a diagrammatic view of the invention placed in an air filter.

In FIG. 3C a closer view of the air cleaner (200) of FIG. 3B is shown. The device (100) of FIG. 1*a* is now seen to lie within the air intake (33) of the air cleaner (200). Clip (14) secures the device (100) of FIG. 1*a* to the intake (33) of the air cleaner by resting over the outside surface of the intake (33) so that the device (100) of claim 1 can be placed inside the air intake. Although a clip is shown herein, other securement means may also be used.

Figure 4A:
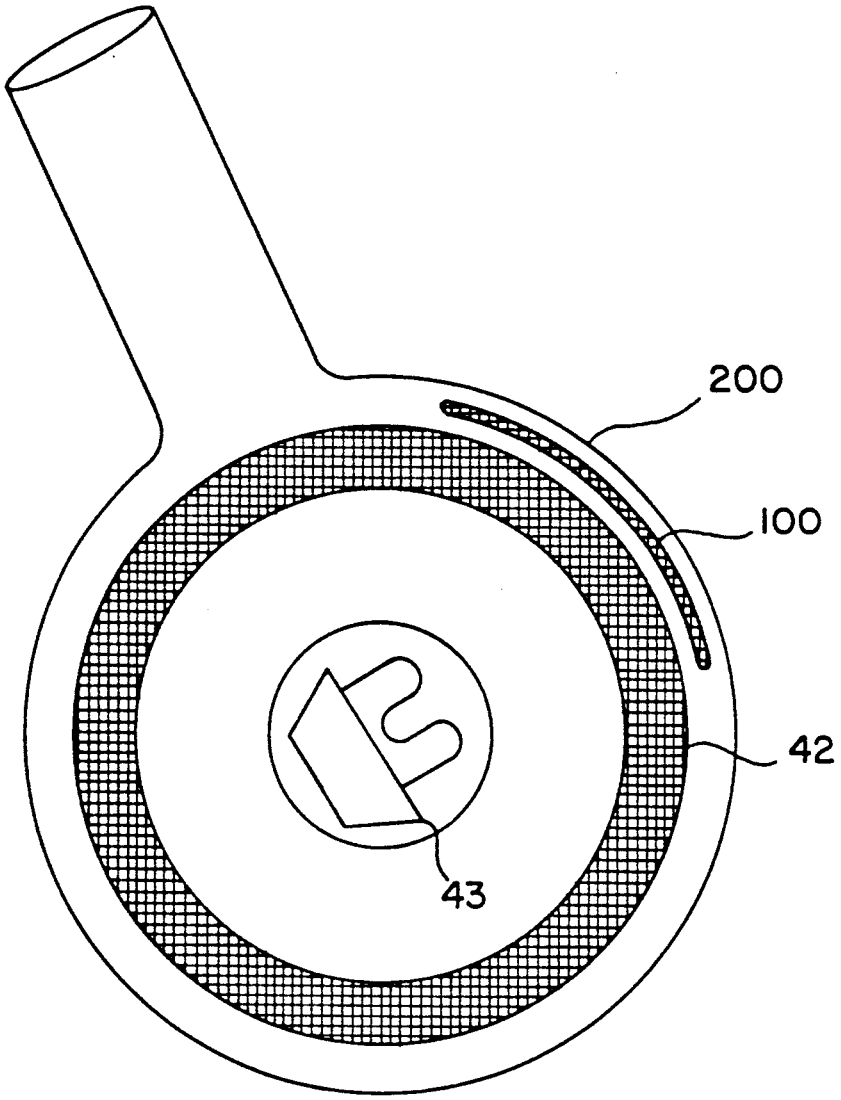
FIG. 4A is a top view of an open air filter.

FIG. 4A shows a top view of an air cleaner (200) with the top cover (21) removed. The throat of the carburetor (43) can be seen from this view. A circular air filter (42) lies around the outer circumference of the inside portion of the air cleaner (200). Parallelling this arrangement is the device of FIG. 1*a* lying between the outside wall of the air cleaner and the outside surface of the air filter (200). This embodiment is merely an amplification of FIG. 3.

Figure 4B:
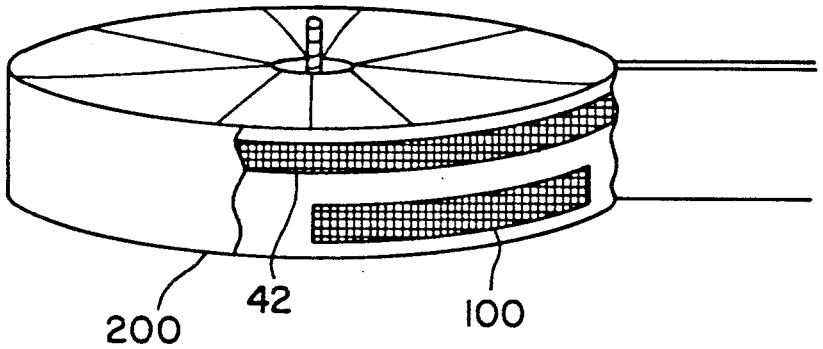
FIG. 4B is a side view partly in section of the air filter of FIG. 4A.

In FIG. 4B, a side, partially in section view of FIG. 4A is shown to further illustrate the positioning of the device (100) of FIG. 1*a* in the outermost circumference of the inside portion of the air cleaner (200).

From the foregoing it is apparent that the present invention can be fitted in multiple places to affect the incoming air stream of a combustion engine. In such positioning, it will out-gas catalyst or an agent that acts like a catalyst to thereby attempt improve the combustion efficiency of a combustion engine and reduce harmful emissions from a combustion engine. The device is easy to install, remove and replace and simple and inexpensive to manufacture. The device has no mechanical or electrical parts and requires no mechanical alteration or adjustment for use in a combustion engine. By controlling the number of perforations and wicks, the rate of out-gassing can be controlled.

The present invention is claimed as follows.

We claim:

1. A discardable device for placement within the air intake system of any combustion engine, said device being comprised of a package having a flexible outer covering; and a catalyst contained by said covering, said covering enabling said catalyst to pass therethrough at a controlled rate, wherein the passing of said catalyst through said covering into said air intake system during operation of said engine improves combustion efficiency.

2. The device of claim 1 wherein said covering defines a plurality of openings therein, said openings enabling said catalyst to pass through said covering and affecting the rate of passage of said catalyst through said covering.

3. The device of claim 2 further comprising wicks attached along their lengths to said covering, said wicks being located in spaced intervals on said covering and absorbing and outgassing some of said catalyst.

4. The device of claim 3 wherein said wicks are formed from said covering.

5. The device of claim 3 wherein said wicks are made of cotton or felt and said covering is made of perforated plastic.

6. The device of claim 1 wherein said catalyst is contained in a plurality of absorbent beads held within said covering.

7. The device of claim 1 wherein said catalyst is contained in an absorbent material held within said covering.

8. The device of claim 1 further comprising attachment means attached to said device for removable attachment of said device within said air intake system.

9. A free standing, easily removable and discardable combustion engine air intake system device comprised of a package having a flexible outer covering; and a catalyst contained by said covering, said covering enabling the passing of said catalyst therethrough, wherein said device is placed within an air intake system of a combustion engine, said catalyst passing through said covering into said air intake system during operation of said engine to improve combustion efficiency of said engine.

10. The device of claim 9 wherein said catalyst passes through said covering in a controlled manner.

11. The device of claim 10 wherein said covering defines a plurality of openings in its surface for the controlled release of said catalyst into said air intake system and wherein said device further comprises wicks located around the outside surface of said covering to facilitate passing of said catalyst into the air.

12. The device of claim 11, wherein said catalyst is contained in absorbent means which are contained within said covering.

13. A device for use with an energy producing means, said device being comprised of a flexible casing, and a catalyst contained within said casing, said casing enabling said catalyst to pass at a controlled rate therethrough, said device enhancing the energy producing capabilities of said energy producing means, wherein said device is merely placed in association with said energy producing means without alteration of said energy producing means.

* * * * *